United States Patent [19]

Koch

[11] Patent Number: 4,606,588

[45] Date of Patent: Aug. 19, 1986

[54] GUIDE STRUCTURE FOR A DRAWABLE FURNITURE PART

[75] Inventor: Gerhard Koch, Nagold-Vollmaringen, Fed. Rep. of Germany

[73] Assignee: Häfele KG, Fed. Rep. of Germany

[21] Appl. No.: 720,810

[22] Filed: Apr. 8, 1985

[30] Foreign Application Priority Data

Apr. 17, 1984 [DE] Fed. Rep. of Germany ..... 3414405

[51] Int. Cl.[4] ..... A47B 88/00

[52] U.S. Cl. ..... 312/339; 248/430; 312/330 R; 312/341 R; 384/18

[58] Field of Search ..... 312/337, 339, 340, 341 R, 312/343, 344, 330 R; 308/3.6; 248/430

[56] References Cited

U.S. PATENT DOCUMENTS 2,780,501 2/1957 Rosenberg ..... 312/337 X 3,205,025 9/1965 Jordan ..... 312/341 R 3,272,583 9/1966 Averdieck ..... 312/343

FOREIGN PATENT DOCUMENTS 164119 6/1921 United Kingdom ..... 312/339

*Primary Examiner*—James T. McCall

*Attorney, Agent, or Firm*—McGlew and Tuttle

[57] ABSTRACT

One of two drawable furniture parts have an outer rail made from a triangular hollow section having a lengthwise slot for receiving an inner rail. The outer rail is mounted on an inner rail and rides on a triangular array of balls. The inner rail is made of two superposed U sections whose inside legs are flatly welded together and have their edge portions bent apart to form a track for the upper row of balls. The two lower rows of balls are received in the triangular hollow section below the bent edge portions.

8 Claims, 2 Drawing Figures

GUIDE STRUCTURE FOR A DRAWABLE FURNITURE PART

FIELD AND BACKGROUND OF THE INVENTION

This invention relates in general to drawable furniture parts and in particular to a new and useful guide structure for such parts.

Known are draw guides for drawers in which the outer rail is supported on the inner rail for displacement on balls which are retained in cages. The outer rail comprises a hollow triangular section with a lengthwise slot for the passage of the inner rail. The inner rail is a solid rail having a triangular cross section, with ball tracks being formed on the corners. The manufacture of such solid rails is relatively expensive and material consuming.

SUMMARY OF THE INVENTION

The present invention is directed to a guide structure which is simple in design, not heavy, inexpensive and requires much less material. This is obtained, in accordance with the invention by providing that the drawer including a rail guided in a triangular inner rail on balls arranged in a triangular form between the rails. While the upper balls run in the angled portions of the rail strips, the lower balls apply against the flat portions of the rail strips and are prevented from being lifted, by the angled edges. The relatively simple angling of the two strips thus provides the desired three tracks for the balls. By the weight of the furniture part to be drawn, forces are exerted through the upper row of balls on the bent edges, which produce force components directed outwardly. These forces, however, are taken up by the lower rows of balls, so that the two strips are held together by the common supporting means. However, to securely prevent the two strips from spreading, they are advantageously connected to each other by spot welding.

To connect the inner rail to the respective furniture part, an angle section may be employed, as usual. However, another simplification may be obtained by extending at least one of the strips on its free side and bending it to a securing angle. Such a section may be produced, for example, from a metal sheet in a single operation. With a relatively large effort arm between the location of securing at the inner rail, there is always a risk that the inner rail will sag under larger loads of the furniture part. This is prevented by another feature of the invention, namely by providing that two strips forming a rail are bent to include a portion of one overlying the other and are interengaged. Then, if the base part of the inner angled portion extends obliquely to that of the outer angled portion, a triangular structure is formed almost completely preventing the inner rail from sagging.

If it is intended to apply the inventive structure to the multiple draw, etc., the free sides of the strips are made conformable to the inside of the outer shape of the outer rail, angled outwardly and placed in a straddling manner on the underlying rail, so that a structure with two, three or even more guides one above the other is obtained.

Advantageously, a triangular hollow section with a passage slot for receiving the inner rail is selected to form the outer rail. This section is connected by means of a carrier arm to the furniture part. The carrier arm is preferably provided on its supporting end with a threaded bushing extending toward the furniture part and engaging an adjusting bolt whose supporting head has a diameter corresponding to the outer diameter of the threaded bushing. Such an arrangement has the advantage of a throughgoing bore in the furniture part. Since no portions project downwardly, the entire arrangement becomes still more compact.

Accordingly, it is an object of the invention to provide an improved guide structure for gliding parts which includes a first triangular hollow part having a base portion with an opening and a apex over the base portion, and a second part which includes an upright portion extending through the opening of the first part terminating in a rail seat and including a plurality of ball bearings in said first part located on said rail seat and on each side of said second part overlying said base part and abutting said second part.

A further object of the invention is to provide a guide structure which is simple in design, rugged in construction and economical to manufacture.

The various features of novelty which characterize the invention are pointed out with particularity in the claims and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
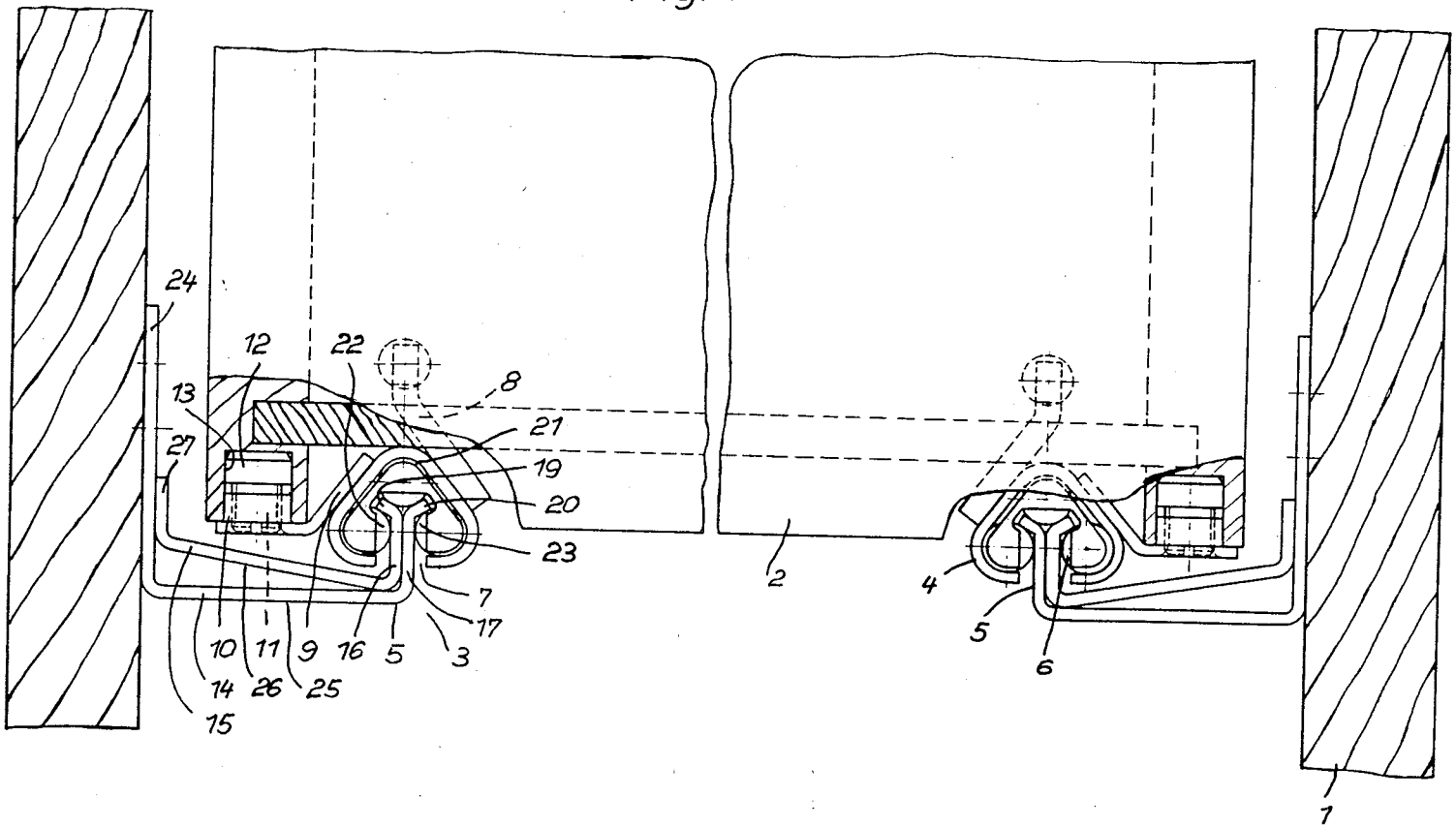
FIG. 1 is a partly sectional front view of the furniture part with a draw on a simple guide constructed in accordance with the invention.

Referring to the drawings in particular the invention embodied therein comprises a guide structure particularly for a drawable part of furniture, comprises a first or outer triangularly shaped hollow part, or which has a flat base and a central opening in an apex above the opening. The second inner rail part 5 includes an upright portion which extends through the opening of the base of the first part and terminates at its stop in a rail structure defining a ball seat permitting a plurality of balls 6 rolled thereon. The construction includes roller balls 6 disposed in the hollow triangular part 4 which are disposed over the seat portion and on each side of the upright portion of the second inner rail part 5. The structure is such that the balls 6 are confined on each side of the upright portion over the base of the first outer rail triangular portion 4. The seat of the rail portion is formed by outwardly divergent end portions 20 and 21 of a strip part 16 and 17 which extend through the opening in the base of the first or outer rail part 4. The edge portions 19 of strip part 16 and 20 of strip part 17 also engage the balls on their lower outer edges and confine the balls over the base portion of the first triangular hollow part 4.

In a furniture part 1, a drawer 2 is mounted on two guides generally designated 3. The guide 3 comprises an outer rail 4 which is supported on an inner rail 5 by means of balls 6.

Outer rail 4 is made from a triangular, hollow section and has a lengthwise slot 7 for inner rail 5. Outer rail 4 is connected to drawer 2 on one side, by a carrier 8, and on the other side through a carrier arm 9. The carrier arm 9 is provided with a threaded bushing 10 which extends toward drawer 2 and receives an adjusting bolt 11. A heat 12 of adjusting bolt 11 bears against the bottom of a throughgoing bore 13 and has an outer diameter corresponding to the outer diameter of bushing 10, so that a relatively long guideway is obtained within wall 12 without the necessity of providing a shoulder. Nothing projects below the carrier arm 9, so that the structure is relatively compact.

The inner rail 5 is assembled of two metal sheet U-sections 14 and 15. The lower legs of inner leg portions 16 and 17 of the U-sections apply flatly against each other and connected to each other by spot welding.

Their free edge portions or inner margins 19 and 20 are bent apart by about 45° and form a track for an upper row of balls or bearings 21. Two lower rows of balls 22 and 23 are supported directly against legs 16 and 17 and are prevented from moving upwardly by the bent edge portions 19 and 20. The load acting through the upper row of balls 21 does produce a pressure pushing legs 16, 17 outwardly, however, this pressure is taken up by the two lower rows of balls 22 and 23.

The outer U-section 14 is secured by an outer leg 24 to the wall of a furniture part 1. Since a web portion 25 of the outer U-section 14 is relatively broad and thus forms a large effort arm, a web portion 26 of the inner U-section 15 acts as a reinforcement, the two legs 24,27 being firmly connected to each other. Web portion 26 extends obliquely relative to web portion 25 so that a triangular cross section or brace is formed. Balls 6 of the upper row of balls 21 and the two lower rows of balls 22, 23 are received in common cages 28.

Figure 2:
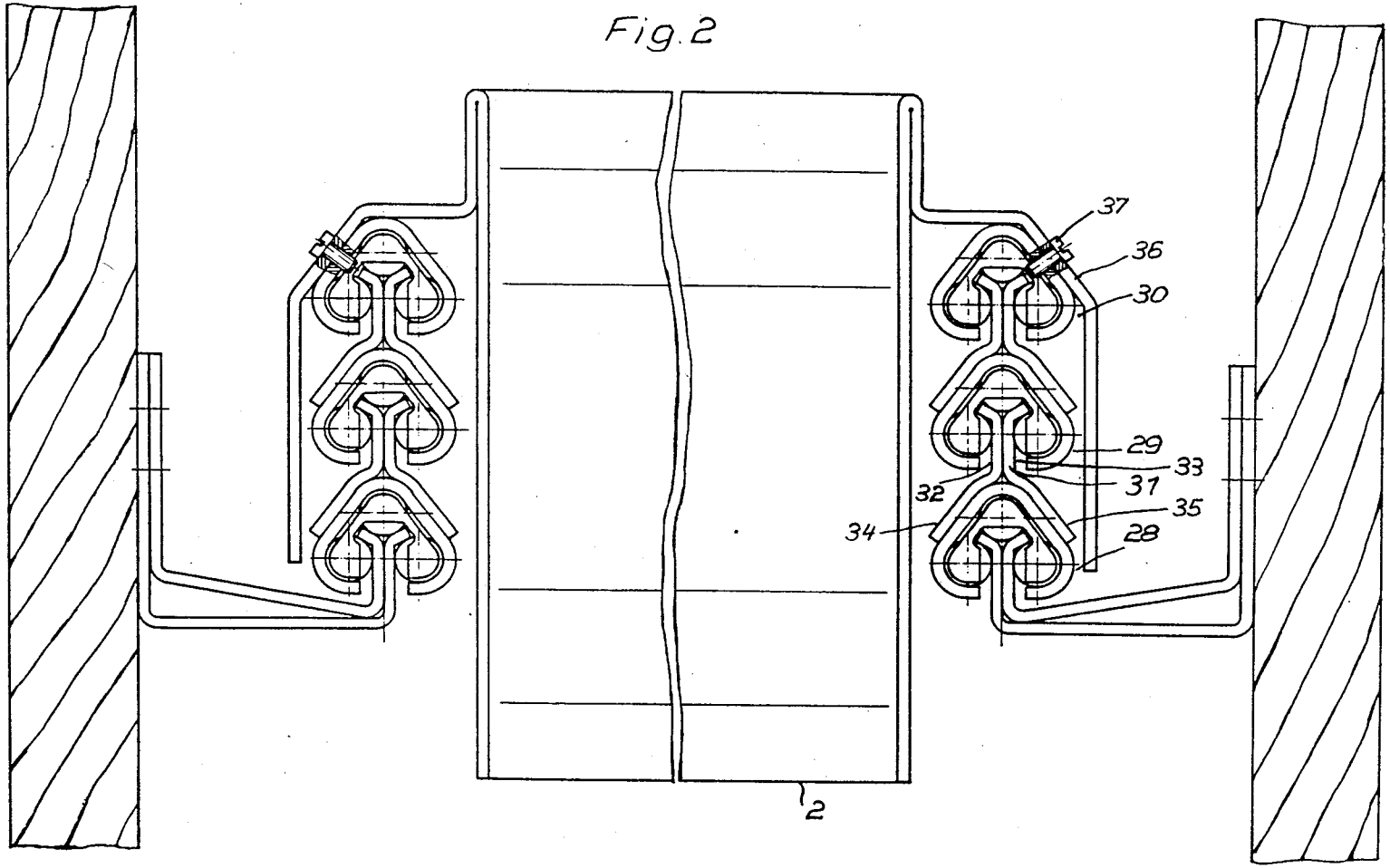
FIG. 2 is a similar view of a triple structure of this kind.

FIG. 2 shows a triple drawer guide structure comprising three guides 28', 29 and 30 one above the other. The lowermost guide 28' is identical in design with guide 3 of FIG. 1. However, outer rail 4 is not directly secured to drawer 2. An inner rail 31 of a superposed guide 29 comprises two strips 32 and 33 having their edge portions bent apart to form legs 34 and 35 which are conformable and secured to outer rail 4. Only the uppermost guide 30 is secured by screws 37 to a fitting 36 which is connected to drawer 2.

While specific embodiments of the invention have been shown and described in detail to illustrate the application of the principles of the invention, it will be understood that the invention may be embodied otherwise without departing from such principles.

What is claimed is:

1. A guide structure, particularly for a drawable part of furniture, comprising an outer rail and a triangularly shaped inner rail, said outer rail extending into said triangularly shaped inner rail and at least three sets of balls arranged within said triangularly shaped outer rail, said inner rail comprising two strips which overlie and abut each other, each having longitudinal end portions closed in the hollow triangular part which are angled apart and define a track for the balls arranged adjacent the apex of said triangular shaped structure.

2. A guide structure particularly for a drawable part of furniture, comprising a first triangular hollow part having a flat base with an opening and an apex above the opening, a second inner rail part including an upright portion extending through the opening of said inner part and terminating at its top in a rail structure defining a ball race portion and roller balls in said hollow part disposed over said ball race portion and on each side of said upright portion over said base portion of said first triangular hollow part, said first inner rail part comprising two strips having portions which are arranged flat against each other, said upright portion including the top having strip portions which are angled away from each other and defines a race for the balls.

3. A guide structure according to claim 2, wherein said strips are connected to each other by spot welding.

4. A guide structure according to claim 2, wherein at least one of said strips is an angle portion spaced from said upright portion which is adapted to be secured to a furniture part.

5. A guide structure according to claim 2, wherein said strips include two substantially U-shaped members which on one side includes an upright portion in which the two strips are in abutment, a base portion in which the inner one of said strips diverges from the other of said strips leading away from said upright portion and including a substantially vertically extending portions of each of said strips which are adapted to overlie each other and to be secured to a furniture part.

6. A guide structure according to claim 2, including a second assembly comprising a second assembly triangular hollow past overlying said first triangular hollow part and a second rail part which includes the upright portion extending into said second assembly first triangular hollow part and a portion which overlies said first triangular hollow part, and is secured thereto.

7. A guide structure according to claim 6, including at least a plurality of second assemblies, one overlying the other with means for securing the upper one of said assemblies to a piece of furniture.

8. A guide structure according to claim 2, including a carrier arm adapted to be connected to a furniture part and having a portion overlying a side of said first triangular hollow part, a threaded bushing carried by said carrier arm which extends into the furniture part and a displaceable bolt engaged with said bushing having a supporting head with a diameter corresponding to the outer diameter of said threaded bushing engaged on said carrier part.

* * * * *